US007051484B2

(12) United States Patent
Nanayakkara

(10) Patent No.: US 7,051,484 B2
(45) Date of Patent: May 30, 2006

(54) METAL STUD FRAME ELEMENT CONSTRUCTION PANEL

(76) Inventor: Lakdas Nanayakkara, 2211 Northeast 54th St., Fort Lauderdale, FL (US) 33308

( * ) Notice: Subject to any disclaimer, the term of this patent is extended or adjusted under 35 U.S.C. 154(b) by 0 days.

(21) Appl. No.: 10/659,781

(22) Filed: Sep. 8, 2003

(65) Prior Publication Data

US 2005/0000184 A1 Jan. 6, 2005

Related U.S. Application Data

(63) Continuation-in-part of application No. 09/480,133, filed on Jan. 10, 2000, now Pat. No. 6,615,563.

(51) Int. Cl.
*E04C 3/30* (2006.01)

(52) U.S. Cl. ..... 52/481.1; 52/730.2; 52/309.12; 52/715; 52/731.9

(58) Field of Classification Search ..... 52/714, 52/414, 481.1, 730.2, 715, 600, 309.12, 383, 52/319, 731.9, 733.3
See application file for complete search history.

(56) References Cited

U.S. PATENT DOCUMENTS 1,862,831 A * 6/1932 Ryan ..... 52/259
3,217,460 A * 11/1965 Downing, Jr. ..... 52/733.3
3,363,371 A * 1/1968 Villalobos ..... 52/91.3
3,760,540 A 9/1973 Latoria et al.
4,472,919 A * 9/1984 Nourse ..... 52/601
4,885,884 A * 12/1989 Schilger ..... 52/354
4,970,838 A * 11/1990 Phillips ..... 52/250
5,313,753 A 5/1994 Sanger
5,335,472 A * 8/1994 Phillips ..... 52/742.14
6,151,858 A * 11/2000 Ruiz et al. ..... 52/481.1
6,385,933 B1 5/2002 Owens
6,443,666 B1 * 9/2002 Smith ..... 405/286
6,708,459 B1 * 3/2004 Bodnar ..... 52/356

* cited by examiner

*Primary Examiner*—Carl D. Friedman
*Assistant Examiner*—Basil Katcheves
(74) *Attorney, Agent, or Firm*—Melvin K. Silverman

(57) ABSTRACT

The instant invention relates to a metallic stud frame construction panel definable in terms of an x, y, z coordinate system. Each stud of the panel includes a z-axis elongate substantially rectangular integral steel web within a yz plane and further includes (i) a first series of xz plane tabs projecting from a first z-axis edge of the web in an x-axis direction, the tabs interdigitating with void spaces, and (ii) a second series of xz plane tabs projecting from an opposite z-axis edge of the web in a like x-axis direction, each tab of the second series staggered relative to the first series of tabs. The panel structure also includes first and second xy plane concrete slabs cast about the first and second series of tabs. The slabs are integrally molded about their y- and z-axis peripheries, after a volume of the panel existing between the series of tabs has been filled with an acoustic and/or thermal insulator. The concrete slabs are reinforced thru the use of re-bars.

6 Claims, 14 Drawing Sheets

METAL STUD FRAME ELEMENT CONSTRUCTION PANEL

REFERENCE TO RELATED APPLICATION

This case is a continuation-in-part of application Ser. No. 09/480,133, filed Jan. 10, 2000, entitled Metal Stud Frame, now pending.

BACKGROUND OF THE INVENTION

The present invention relates to metallic stud frames of a type used in the formation of construction panels used in residential, commercial and roadside applications.

Historically, such panels were formed of combinations of wood, steel or concrete. In the case of load bearing structures, it is common to use a steel bar, known as rebars, within a poured concrete structure. The use of vertical light gauge steel studs, e.g., 10–25 gauge, in lieu of wooden studs to accomplish internal framing within a wood frame structure, is also known in the art. It is, however, not known to employ specially-configured thin gauge vertical studs in combination with exterior and interior wall concretes in which the vertical stud operates to define an offset distance between exterior and interior poured concrete walls having vertical steel studs and insulative materials therebetween.

A need for such a steel stud system has arisen as a consequence of rapid on-site assembly high techniques employing thin internal concrete walls which have developed in the construction arts. Therein, the prior art is reflected in such patents as U.S. Pat. No. 3,760,540 (1973) to Latoria et al, entitled Pre-Cast Concrete Building Panels; U.S. Pat. No. 5,313,753 (1994) to Sanger, entitled Construction Wall Panel and Panel Structure; and U.S. Pat. No. 6,385,933 (2002) to Owens, entitled Pre-Cast Wall Panel. The present invention, primarily because of the special geometry of its thin gauge steel vertical studs, represents an improvement over the prior art in its area.

SUMMARY OF THE INVENTION

The instant invention relates to a metallic stud frame construction panel definable in terms of an x,y, z coordinate system. Each stud of the panel includes a z-axis elongate substantially rectangular integral steel web within a yz plane thereon and further includes (i) a first series of xz plane tabs projecting from a first z-axis edge of said web in an x-axis direction, said tabs interdigitating with void spaces therebetween, and (ii) a second series of xz plane tabs projecting from an opposite z-axis edge of said web in a like x-axis direction, each tab of said second series staggered relative to said first series of tabs. The panel structure further includes first and second xy plane concrete slabs cast about said first and second series of tabs respectively. Said slabs are integrally molded about the y- and z-axis peripheries thereof, after a volume of said panel existing between said series of tabs has been filled with an acoustic and/or thermal insulator. Said concrete slabs are reinforced thru the use of re-bars.

It is accordingly an object of the present invention to provide a metallic stud framing element particularly adapted for use within a concrete panel structure having properties of acoustic and/or thermal insulation.

It is another object to provide a panel of the above type which can function as an interior-to-exterior wall or as outdoor sound barrier.

It is a further object of the invention to provide a vertical metallic stud panel capable of defining the shape and extent of vertical load bearing concrete columns within a poured concrete structure.

The above and yet other objects and advantages of the present invention will become apparent from the hereinafter set forth Brief Description of the Drawings, Detailed Description of the Invention and Claim appended herewith.

DETAILED DESCRIPTION OF THE INVENTION

Figure 1:
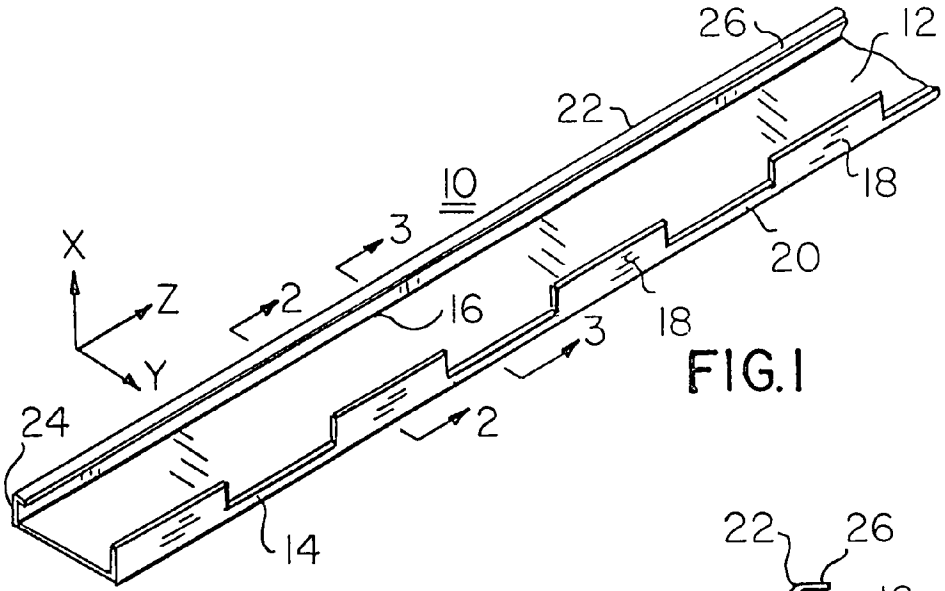
FIG. 1 is a perspective view of an inventive metallic stud.

With reference to the perspective view of FIG. 1, the present inventive metallic stud for use in the framing of structures may be seen to be definable in an x,y,z coordinate system which is shown as a part of FIG. 1.

More particularly, an inventive stud 10 may be seen to include an integral web 12 having a z-axis elongate structure, which is substantially rectangular. Web 12 includes a first major base 14 and an opposing second major base 16, which bases are substantially parallel with each other. See also FIGS. 2 and 3.

Figure 2:
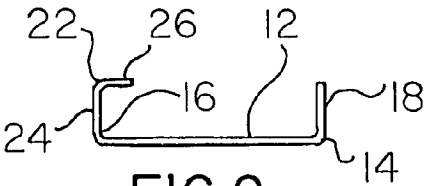
FIG. 2 is a transverse cross-sectional view taken through Line 2—2 of FIG. 1.
Figure 3A:
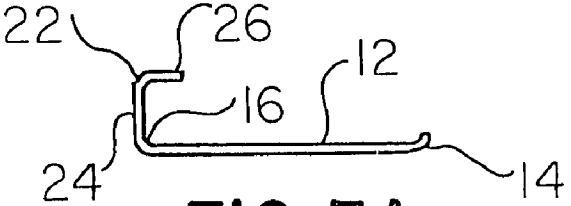
FIG. 3A is a transverse cross-sectional view, of a further embodiment, taken along Line 3—3 of FIG. 1 in which the x-axis dimension of the lesser dimension tabs of the invention is zero.
Figure 3:
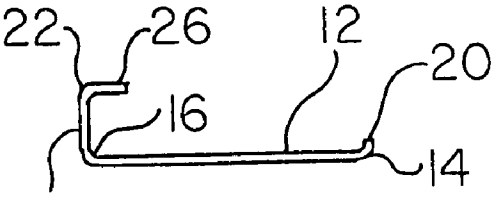
FIG. 3 is a transverse cross-sectional view taken through Line 3—3 of FIG. 1.

The instant framing stud may, with reference to FIGS. 1 and 2, be further seen to include a series of xz plane tabs 18 and 20 which project into an x-axis direction. It is, however, noted that said tabs 18 alternate in x-axis extent between interdigitating greater dimensions said (said tabs 18) and lesser dimensions (tabs 20) of said series. It is noted that a z-axis line of dependency, which is co-linear with said first major rectangular base 14, exists between an xz plane which is common to all of said tabs 18 and 20 and the yz plane of said integral web 12.

With reference to the opposite side of stud 10, there is provided a z-axis elongate L-shaped element 22 which is integrally dependent from said second major rectangular base 16 along a z-axis line of dependency therefrom. As may be further noted, said element is bi-planar and, therefrom, includes an elongate integral xz plane sub-element 24 which extends into a z-axis direction and which is substantially parallel with said interdigitating series of tabs 18 and 20. Said L-shaped element 22 further includes a yz plane sub-element 26 which is also z-axis elongate, but which projects in the direction of said tabs 18 and 20, and is preferably parallel with the plane of web 12.

Figure 2B:
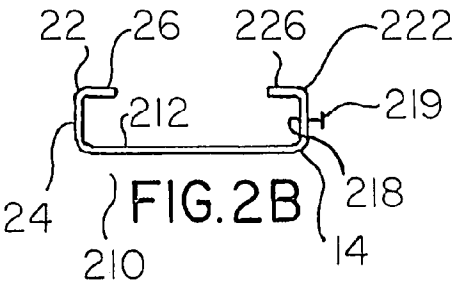
FIG. 2B is a transverse cross sectional view, similar to the view of FIG. 2, however, showing a third embodiment of the inventive metallic stud.
Figure 2A:
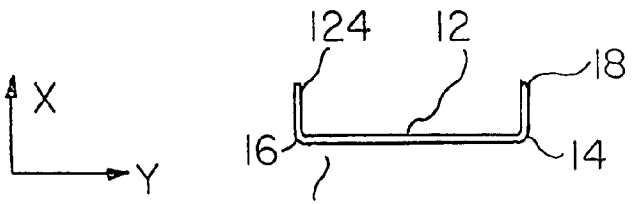
FIG. 2A is a transverse cross-sectional view, similar to the view of FIG. 2, however, showing a second embodiment of the present invention.
Figure 2D:
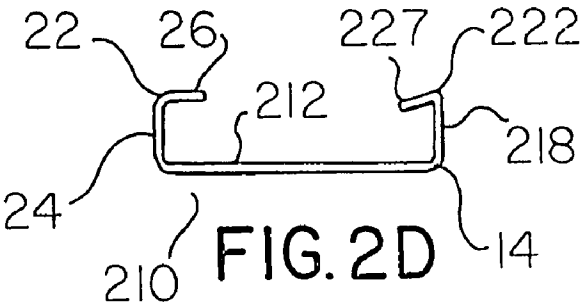
FIG. 2D is a transverse cross-sectional view, similar to the view of FIG. 2, however, showing an embodiment of the metallic stud in which the yz sub-element thereof is not substantially parallel with the xy plane web of the invention.

Shown in FIG. 2A is a second embodiment of the invention which differs from the preferred embodiment, shown and described with reference to FIGS. 1 and 2 above, in that said yz plane sub-element 26 of the L-shaped element 22 is not employed. Accordingly, as may be noted in FIGS. 2 and 2A, in the second embodiment of the invention, the right sides of the respective figures is the same. However, with respect to L-shaped element 124 of the second embodiment, namely, stud frame element 110, there exists only an integral xz plane sub-element 124. Accordingly, in this embodiment, the stud frame element is symmetrical about a xz plane of symmetry.

With reference to FIG. 2B there is, therein, shown a third embodiment of the invention, namely, metallic stud frame 210 in which the left hand side thereof is identical to the left hand side of the embodiment of FIG. 2. However, at the right hand portion thereof, there is provided an L-shaped member 222 which is symmetric with L-shaped element 22 at the left side of FIG. 2B. Said L-shaped element 222 includes an elongate xz plane sub-element 218 which is integrally dependent from web 212 at first major base 14 of web 212. Extending integrally in a yz plane from sub-element 218 is a yz plane sub-element 226 which is substantially symmetric with said yz plane sub-element 26 of element 22, above discussed. However, in the embodiment of FIG. 2B, there are further provided projecting substantially T-shaped elongate elements 219 which are z-axis longitudinal with respect to each of the sub-elements 218 from which they project in the positive y-axis direction.

Figure 2C:
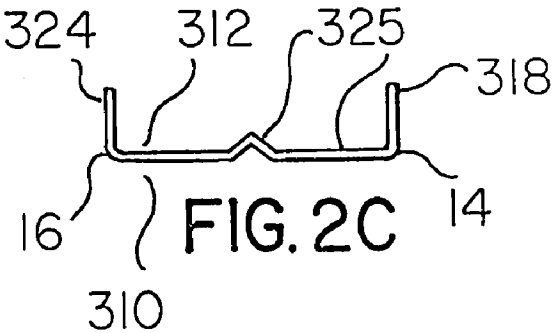
FIG. 2C is a transverse cross-sectional view, similar to the view of FIG. 2, however, showing a further embodiment of the metallic stud.

With reference to the embodiment of FIG. 2C, it is noted that web 12 of the prior embodiments is replaced by a web 312 which is characterized by a by a longitudinal crimp 325 which may, in cross section, resemble a triangle, as is shown in FIG. 2C. This embodiment provides for compressibility between xz surface 318 and 324 of the metallic stud frame. Accordingly, the embodiment of FIG. 2C provides for a stud frame element which is capable of absorbing compressive forces, along the y-axis which may then be absorbed by crimp 325 within web 312.

Figure 4:
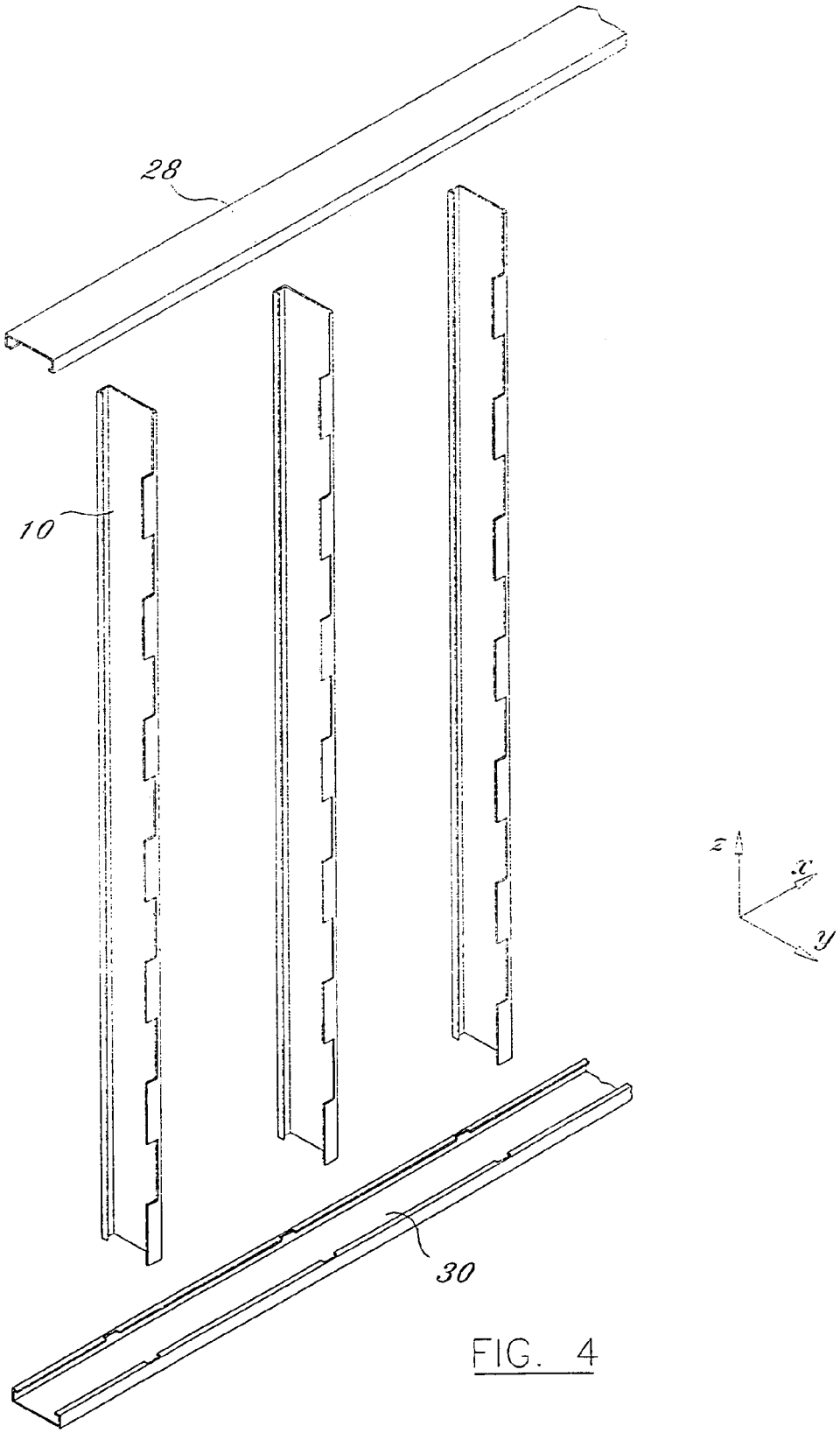
FIG. 4 is an exploded view showing the stud frame of FIG. 1 in combination with upper and lower system framing elements.
Figure 5:
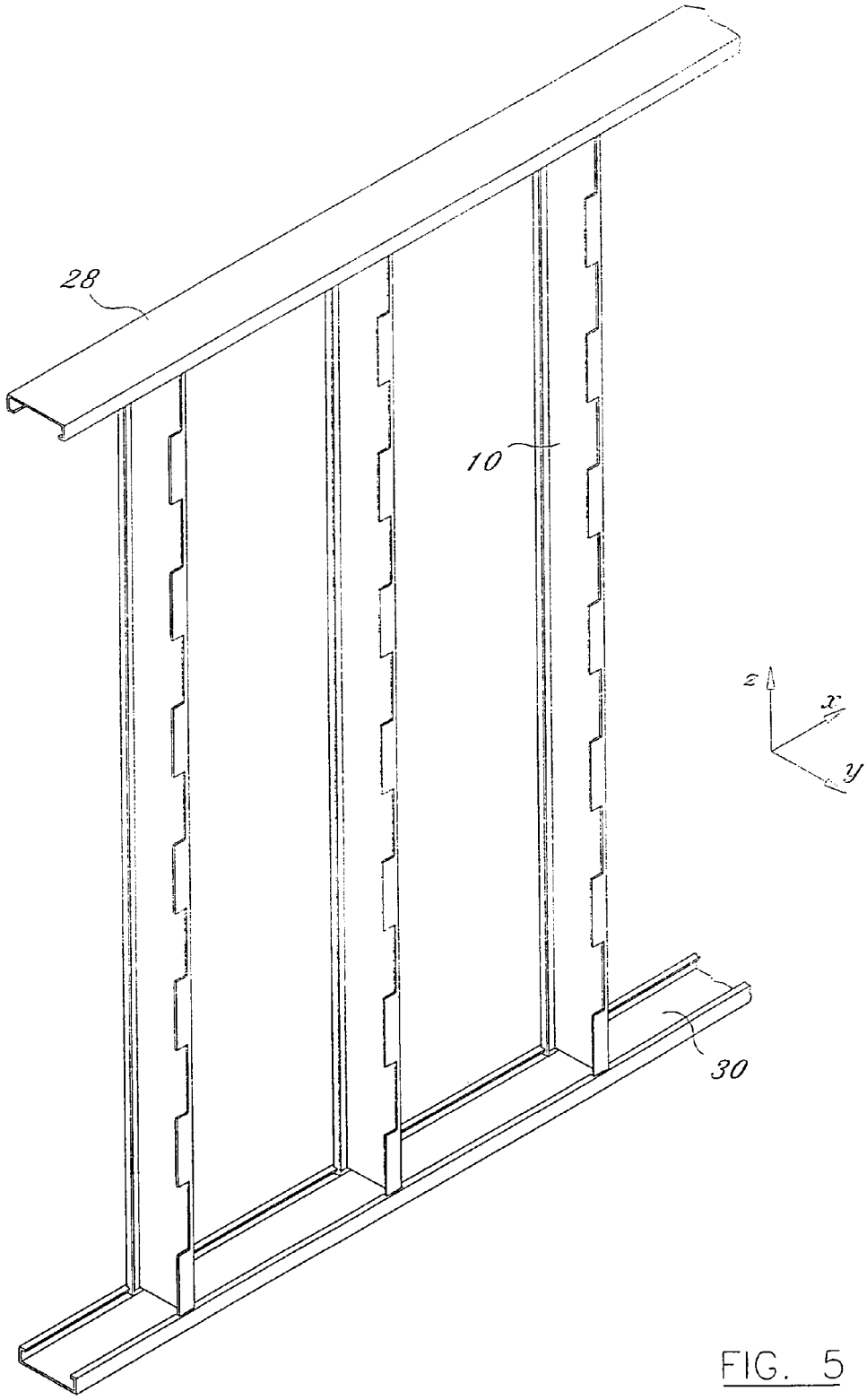
FIG. 5 is an assembly view of the exploded view of FIG. 4.

The fashion of integration of frame stud 10 into a larger structure may be seen with reference to the exploded view of FIG. 4 in which three of the inventive metallic studs 10 are shown in vertical position relative to horizontal framing members 28 and 30. In FIG. 5, the elements of FIG. 4 are shown in assembly view.

Figure 6:
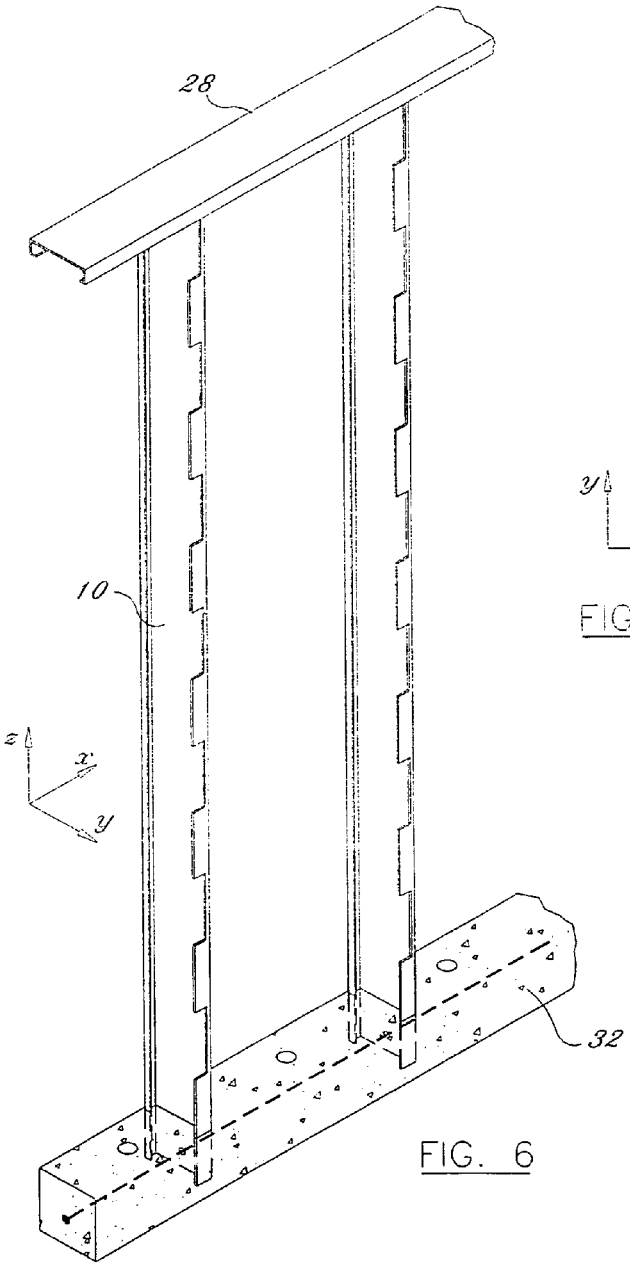
FIG. 6 is a view, further to the view of FIG. 5, in which a concrete base of a resultant structure has been formed.

In FIG. 6, the structure of FIG. 5 is shown, however, with the addition of a horizontal concrete footing 32.

Figure 8:
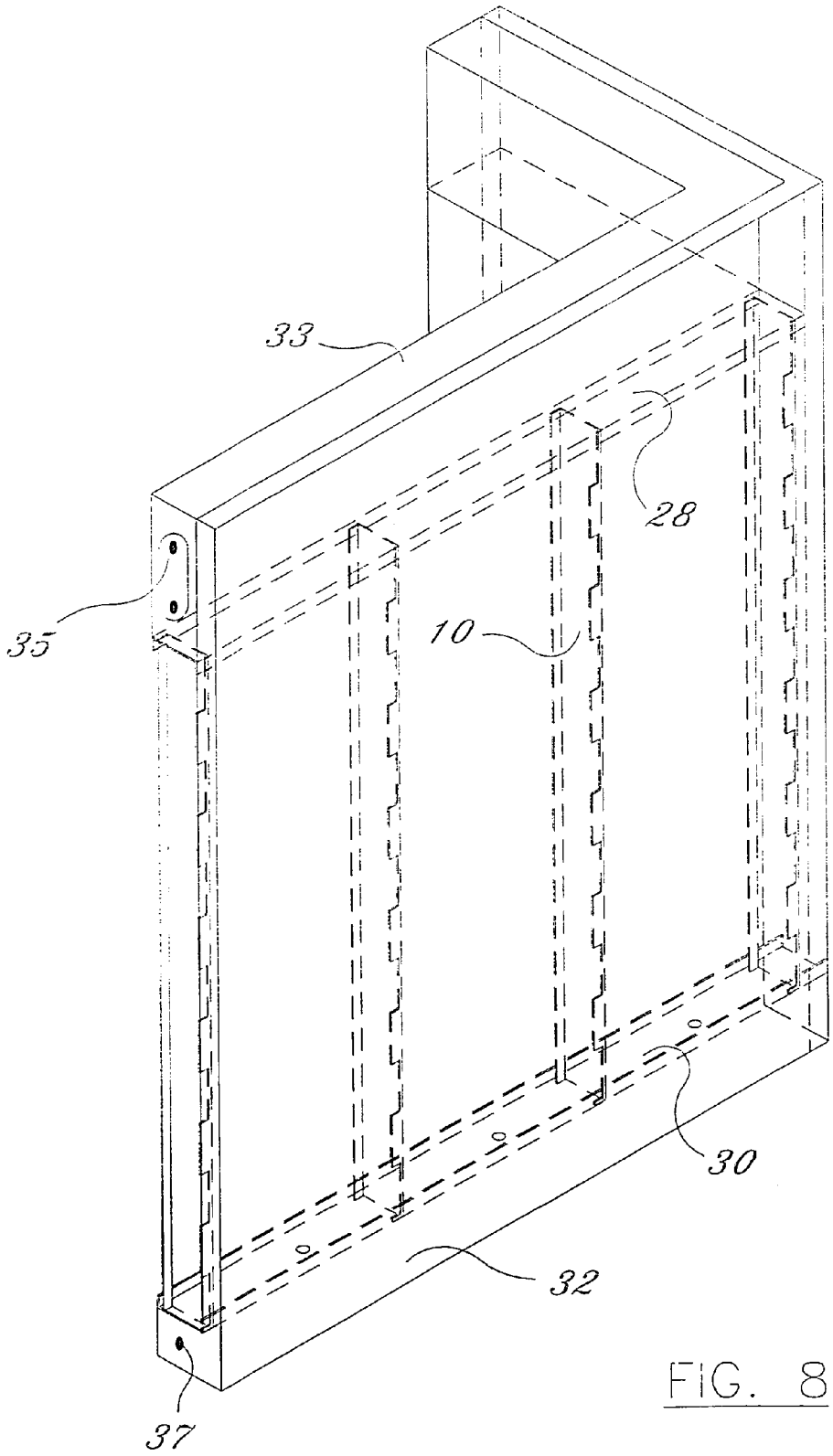
FIG. 8 is a view, further to the view of FIG. 6, in which a concrete capstan of a resultant structure has been formed.
Figure 9:
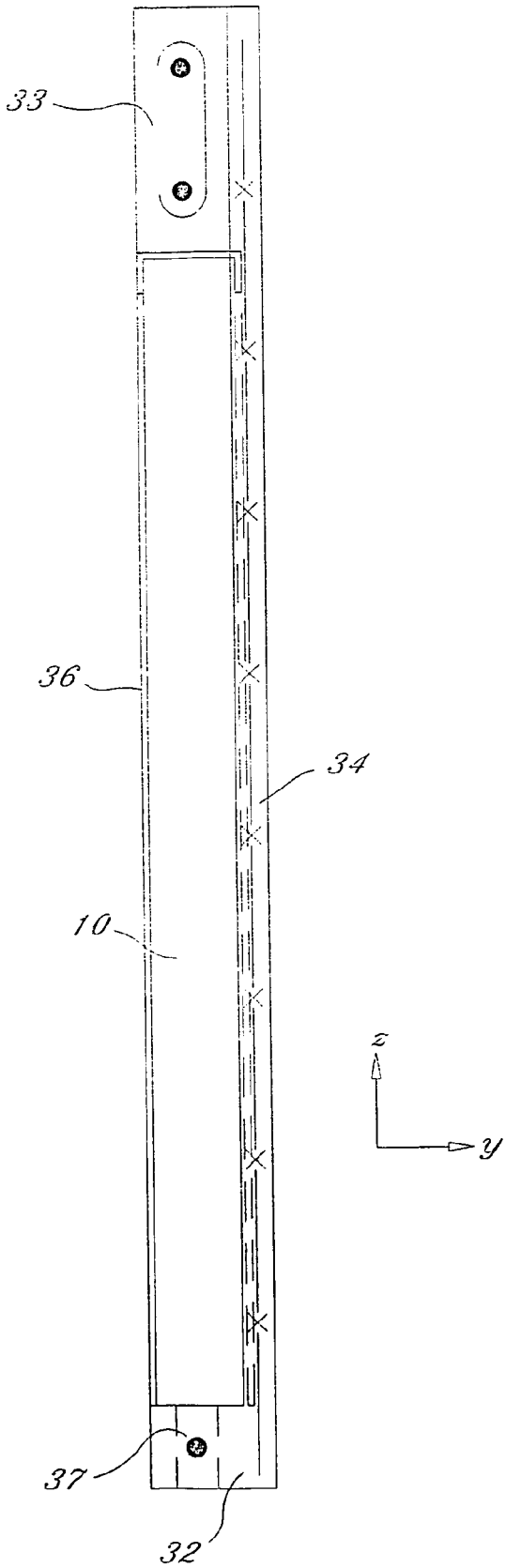
FIG. 9 is a yz plane side view of FIG. 8.

The view of FIG. 8 is further to that of FIG. 6 in which a resultant structure, including a capstan 33, is shown which is cast over horizontal finishing members 28 and 30. Further shown in FIG. 8 are rebars 35 within said capstan, and rebar 37 with footing 32. FIG. 9 is a yz end plan view of FIG. 8, showing the vertical relationship between stud 10 and inner and outer walls of 36 and 34 respectively of a resultant framed structure. Shown within outer wall 34 is wire mesh 41.

Figure 7:
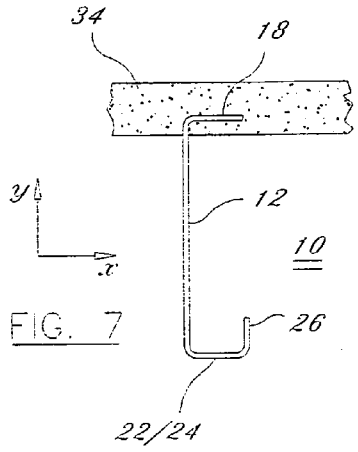
FIG. 7 is a fragmentary bottom horizontal sectional view of a resultant structure showing a xz plane tab of the inventive stud embedded within a poured concrete exterior wall.
Figure 10:
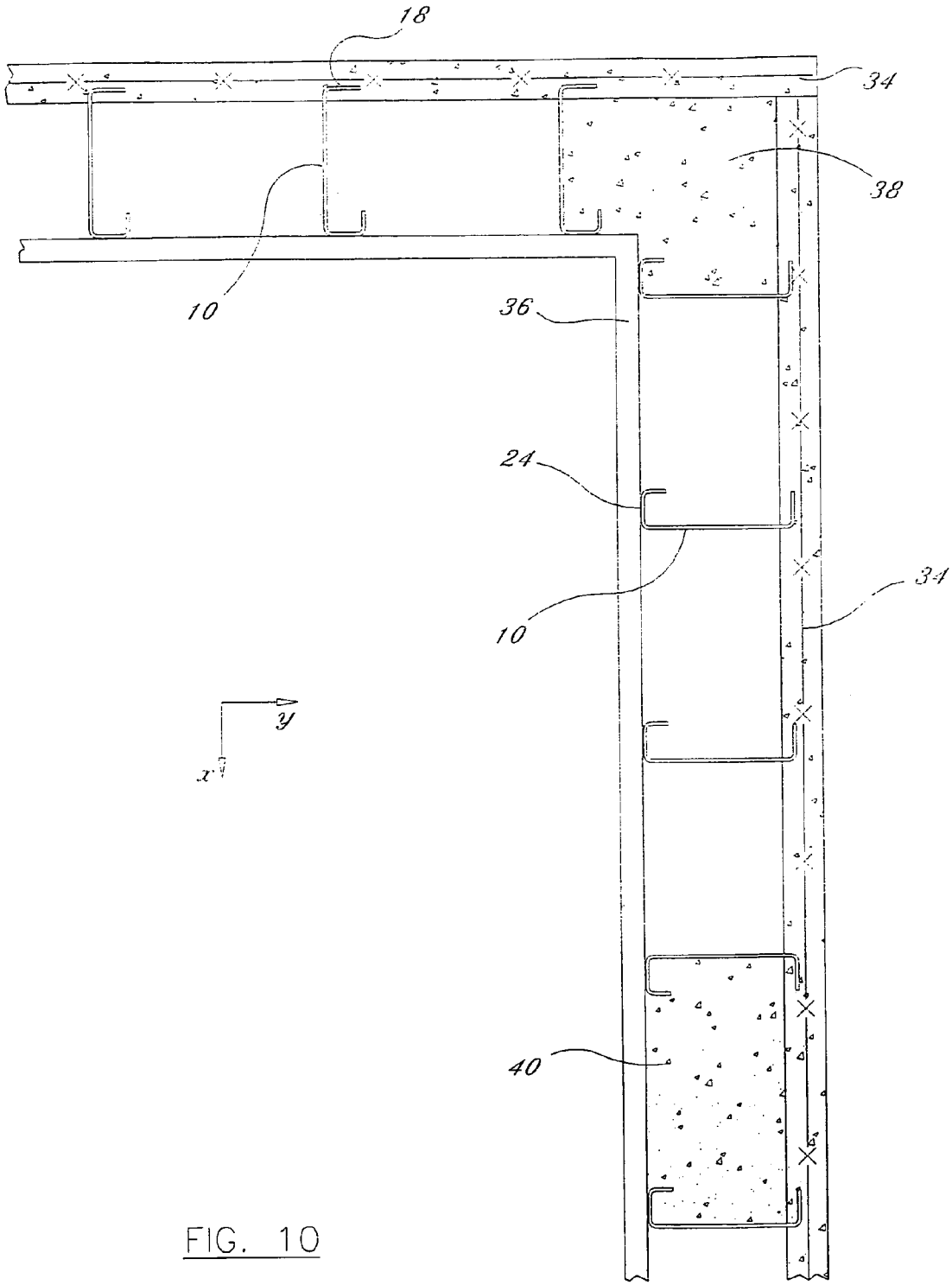
FIG. 10 is a horizontal cross-sectional view of a wall of a structure, further to FIGS. 6 to 7, showing the positioning of steel stud frame elements relative to a poured concrete wall, interior vertical poured concrete columns, and interior plasterboard connected to a curved surface of the stud frame.

In FIGS. 7 is shown the manner in which tabs 18 of the metallic stud 10 are embedded within a thin concrete wall 34, which forms an exterior of the structure to be framed. This may be fully seen with reference to FIG. 10 which comprises a horizontal (xy plane) cross section of a structure with which metallic studs 10 are employed. In FIG. 10 may be further seen the attachment of plaster boards 36 or the like to sub-elements 24 of the metallic stud 10. Such attachment is typically effected through screw attachment, although other means of securement, i.e., glue or adhesion may be employed. As may be further noted in FIG. 10, studs 10 may be used to form vertical molds within into which columns 38 and 40 may be poured to provide load bearing capability to the resultant structure.

The above described metal stud 10 constitutes a cost-effective means for rapid assembly of a large variety of structures which obviates entirely the need for wood, steel I-beams, or heavy steel rebars within concrete. Further, structures resultant from the use of stud 12 do not require large or massive quantities of concrete to produce a structure of suitable resistance to loads and stresses, both horizontally and vertically. In addition, because of vertical concrete columns, such as columns 38 and 40, may be formed through the use of the inventive metallic stud, traditional truss structures may be placed thereupon where special purpose roofing designs are required.

Stud 10 is preferably formed of a light gauge in a range of 16 to 25 gauge.

Figure 11:
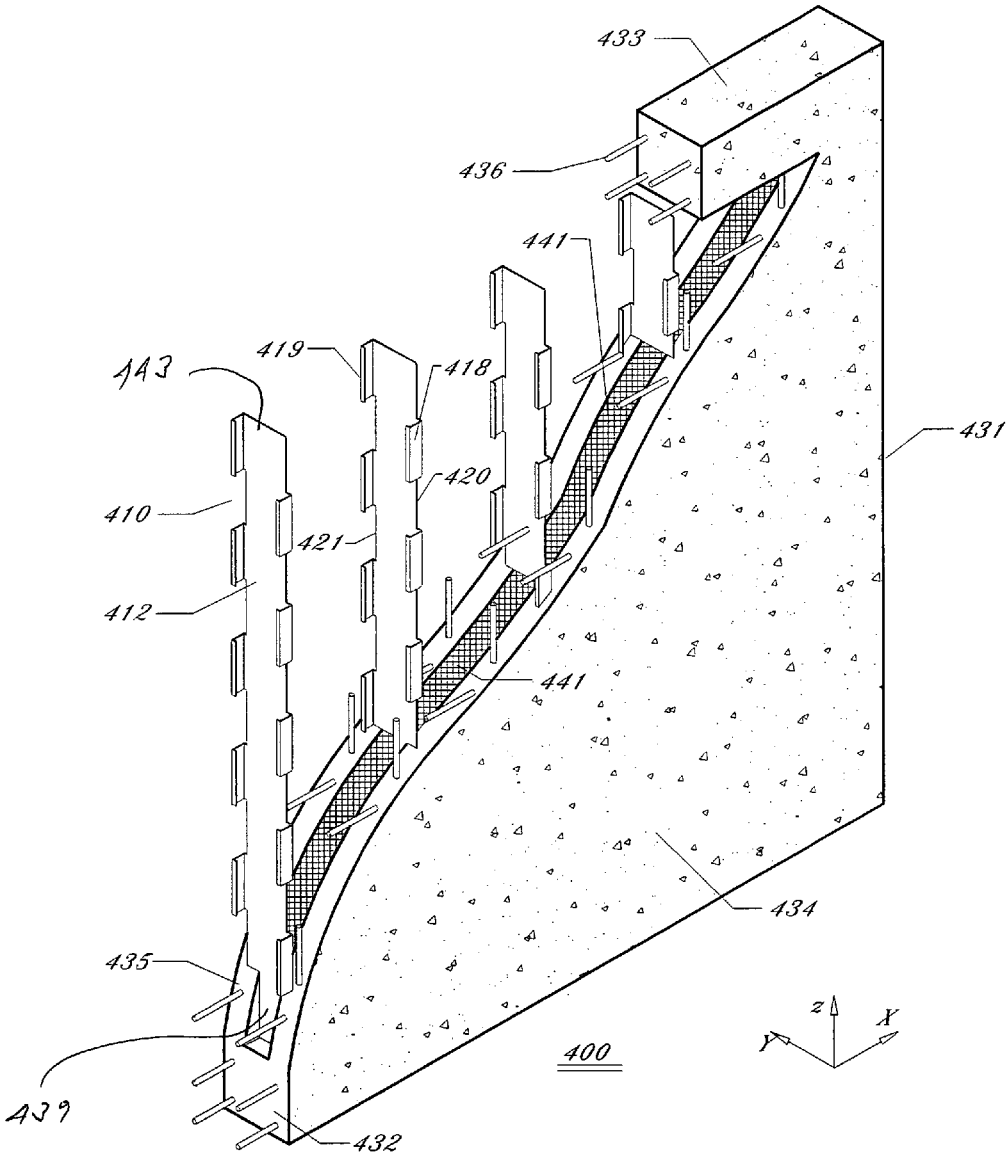
FIG. 11 is a perspective, breakaway view of a further embodiment of the invention in which the inventive metallic stud is embedded between poured concrete interior and exterior walls.

With reference to the perspective breakaway view of FIG. 11, a further application of the above-described metallic studs may be seen. More particularly, the system of FIG. 11 comprises a metallic stud frame construction panel for use as interior and exterior walls of a structure. A panel 400 is definable in terms of an x, y, z coordinate system. Therein, each stud 410 of panel 400 includes a z-axis elongate substantially rectangular integral steel web 412 within a yz plane thereof and, additionally, includes a first series of xz plane tabs 418 projecting from a first z-axis edge 420 of said web 412 in a x-axis direction. Edge 420 also defines a void space. Therein, said tabs 418 interdigitate with void spaces therebetween. Said web 412 also includes a second series of xz plane tabs 419 projecting from an opposite x-axis edge 421 of said web 412 in a like x-axis direction as said first series of tabs 418. Edge 421 also defines a void space. It is to be further noted that each tab 419 of said second series is staggered relative to first tabs 418. That is, the void spaces associated with z-axis edges 421 of web 412 be positioned directly oppose tabs 418 or may be staggered relative to edges 420 of said first series of xz plane tabs 418.

The panel structure 400 of FIG. 11 further includes first and second xz plane concrete slabs 434 and 435 respectively which are cast upon said first and second series of tabs 418 and 419 respectively. Said slabs 434 and 435 are integrally molded about y-axis peripheries through the use of a footing 432 and capstan 433. Said walls 434 and 435 are provided with rebars 436 as are said footing 432 and capstan 433. However, prior to pouring of capstan 433, the volume of said panel 400 which exists between said series of tab 418 and 419, that is, between the opposing interior surfaces of slabs 434 and 435 is filled, as by power spraying, with an acoustic and/or thermal insulation 441. Slabs 434 and 435 also define load-bearing vertical end columns 431. Such columns reduce the potential for twisting of the structure 400. Dovetail ends 439 of each stud 410 improve is horizontal shear capacity, as do rectangular ends 44.

Figure 12:
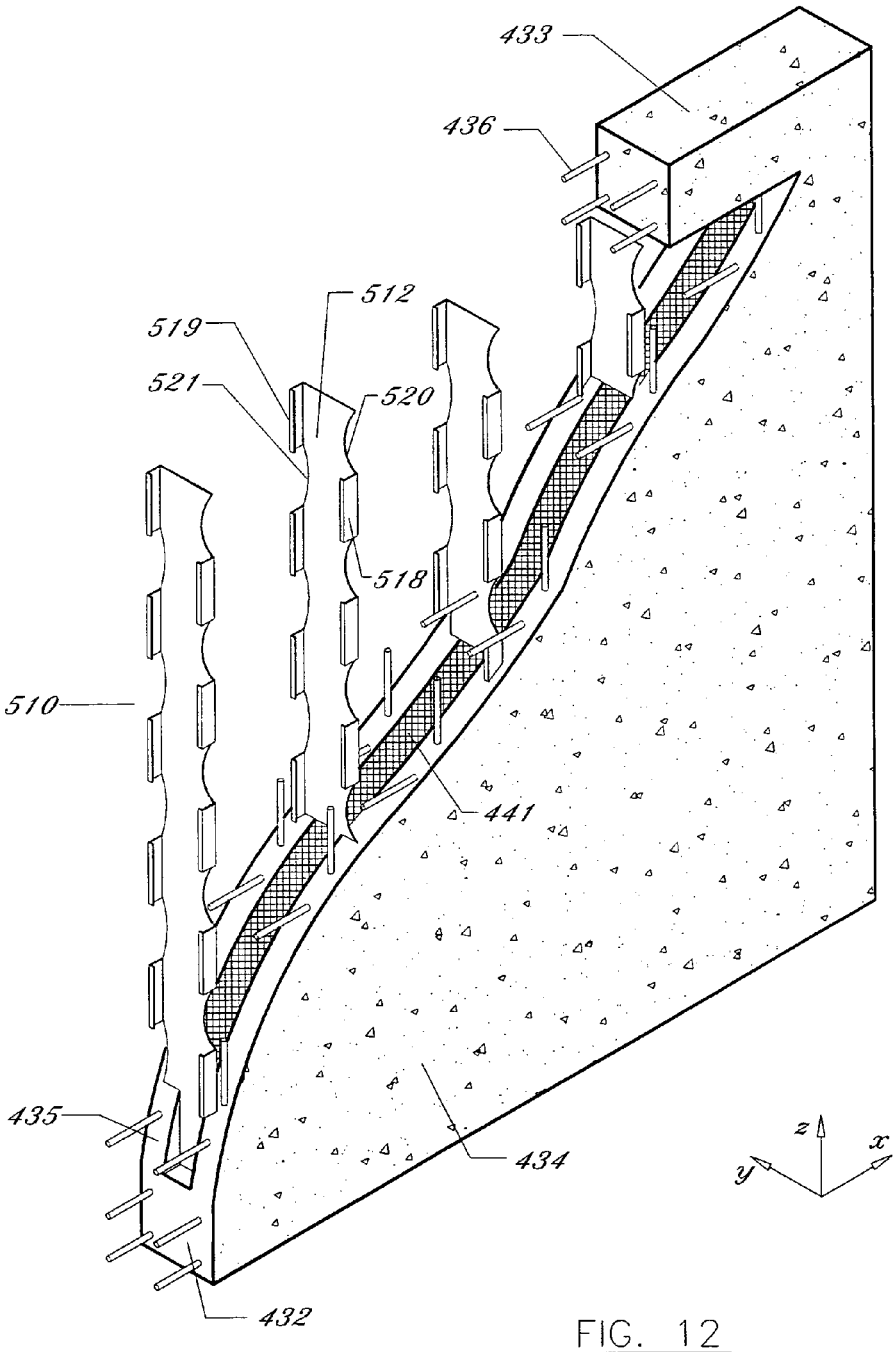
FIG. 12 is a perspective view of a further embodiment of the system of FIG. 11.

In FIG. 12 is shown a further embodiment 500 of the system of FIG. 11 in which said substantially linear y-axis edges 420 and 421 of stud webs 412 are replaced by catenary or scalloped edges 520 and 521. This geometry improves the horizontal shear capacity of studs 510. As in the case in the embodiment of FIG. 11, studs 510 of FIG. 12 also employ a first series of tabs 518 which are, in the z-axis, staggered relative to a second series of tabs 519.

Figure 13:
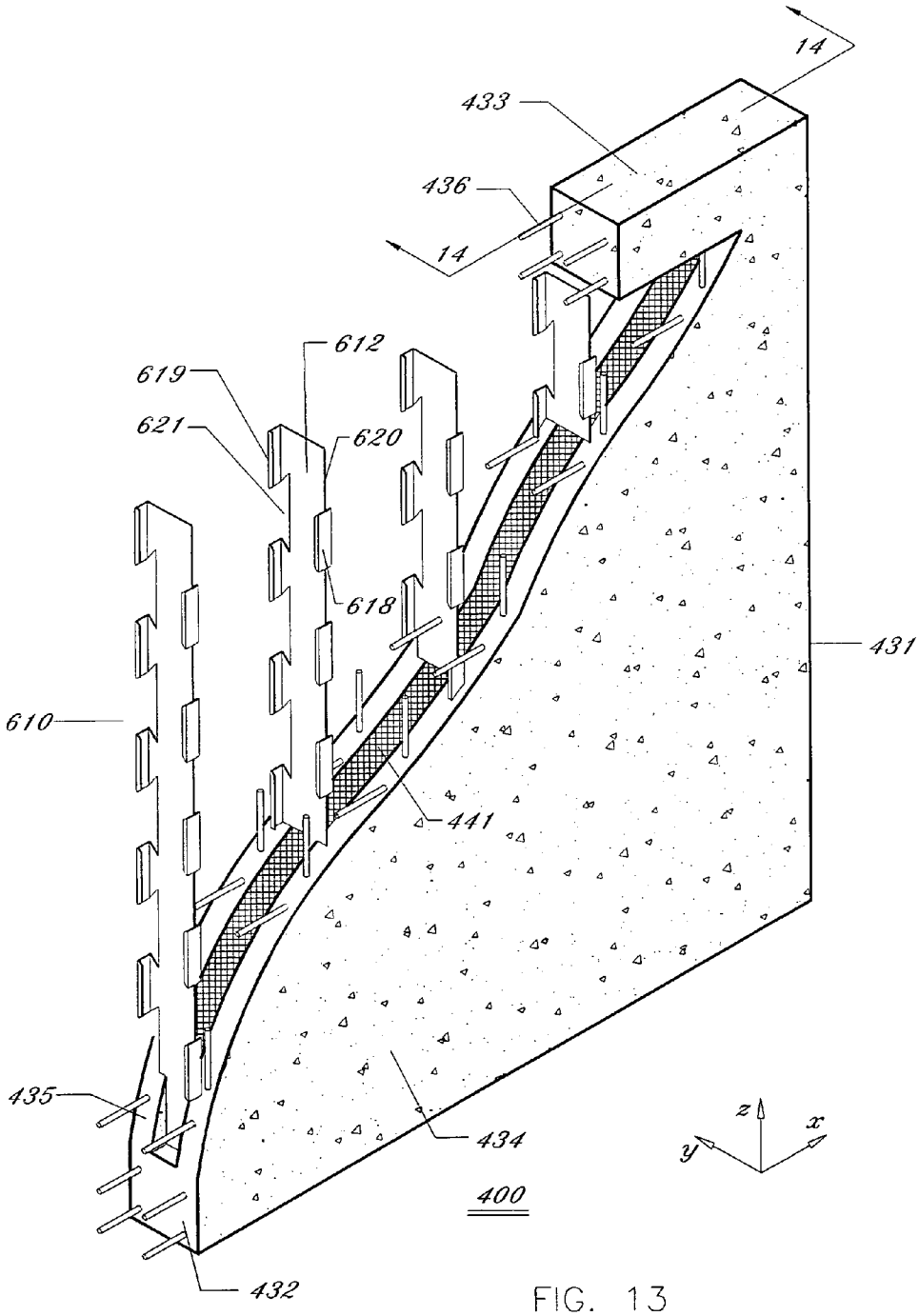
FIG. 13 is a perspective view of a further embodiment of the system of FIG. 11.

Shown in FIG. 13 is a further embodiment 600 of the system of FIG. 11. Therein, studs 612 are provided with void spaces 621 on the plus y-axis edge of webs 612 while the opposite z-axis edge of web 612 exhibits a linear void space similar to edges 420 of studs 410 of the panel system 400 of FIG. 11.

Figure 14:
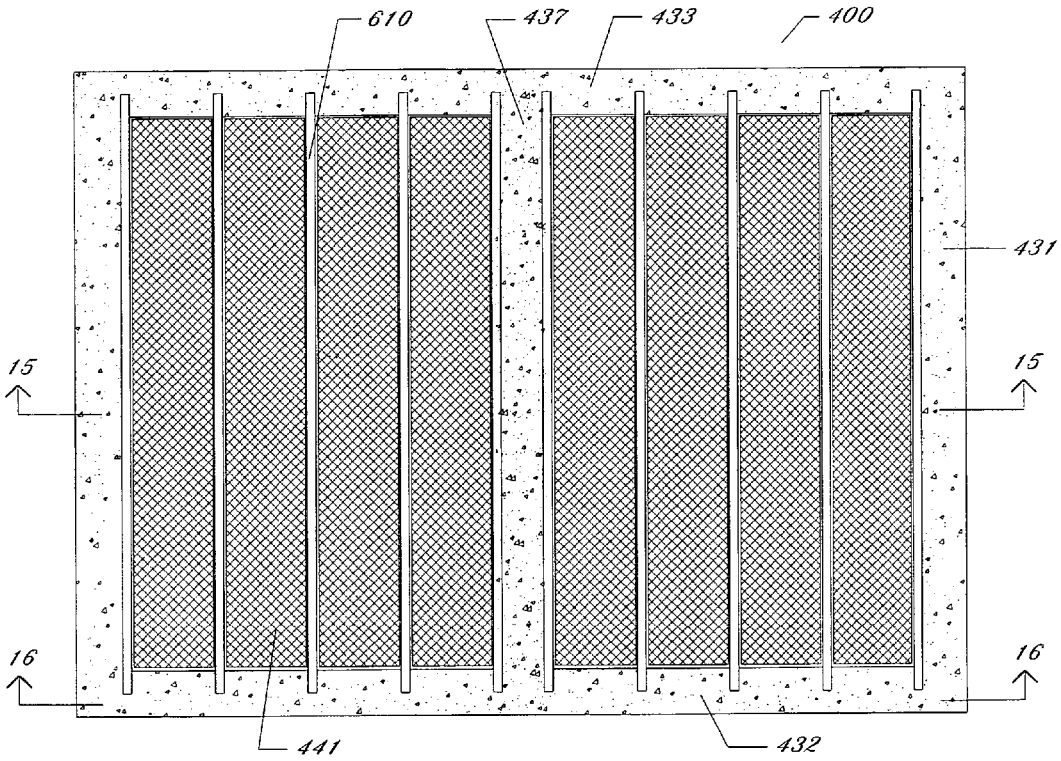
FIG. 14 is a vertical cross-sectional view taken along Line 14—14 of FIG. 13.
Figure 14:
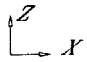

Shown in FIG. 14 is a xz axis vertical cross-sectional view taken through Line 14—14 of FIG. 13. Therein may be seen footing 432 and capstan 433 into which each of said metallic studs 610 of the embodiment of FIG. 13 are embedded when said concrete inner and outer walls 634 and 653 respectively are poured. Also shown are vertical peripheral columns 431 and central vertical weight bearing concrete column 437 of panel 600 which provide resistance to twisting of said panels 400, 500 and 600. Further shown is said insulation 441.

Figure 15:
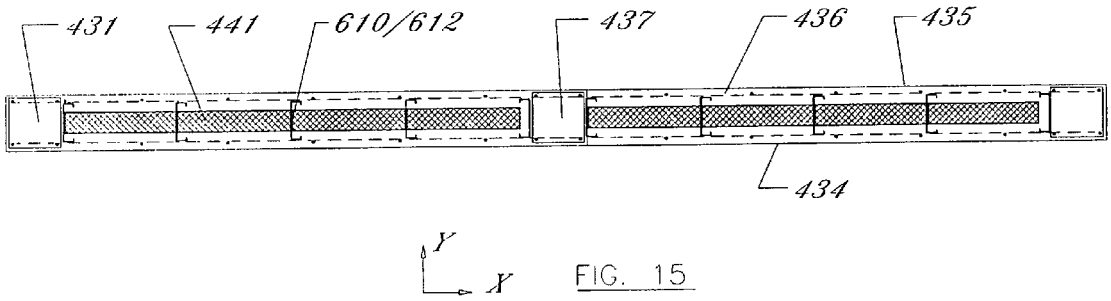
FIG. 15 is a horizontal cross-sectional view taken along Line 15—15 of FIG. 14.
Figure 16:
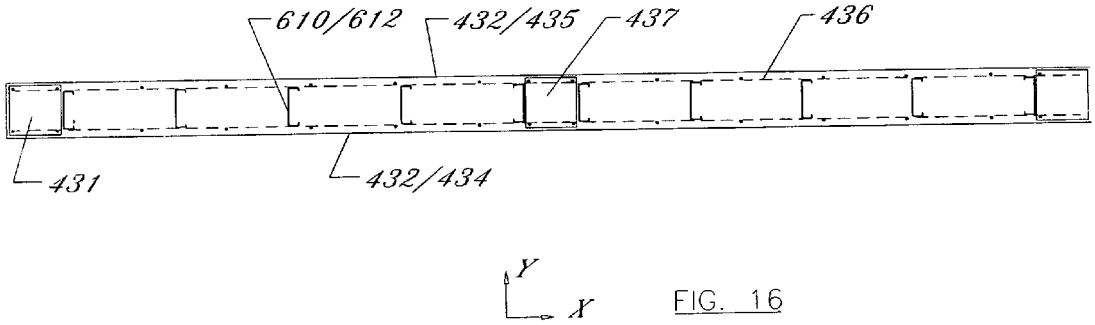
FIG. 16 is a horizontal cross-sectional view taken along Line 16—16 of FIG. 14.

In FIG. 15 is shown a horizontal cross-sectional view of the panel 600 of FIG. 14 taken along Line 15—15 thereof. The capstan 432 of panel 600 is shown in the cross-sectional view of FIG. 16. Therein may be seen the manner in which metal stud frames 610 are embedded within the capstan 432. Where lightweight concrete is used with 16–25 gauge steel studs, a light but highly durable and versatile panel is achieved. Such panels and concrete function in a synergistic way as a single constructional panel.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A metallic stud frame construction panel, definable in terms of an x, y, z coordinate system, said panel comprising:

(a) a plurality of vertically disposed z-axis studs, each stud comprising a z-axis elongate substantially rectangular integral steel web within a yz plane of each stud, each stud further comprising (i) a first series of xz plane tabs depending from a first z-axis edge of said web in a x-axis direction, said tabs interdigitating with void spaces therebetween, and (ii) a second series of xz plane tabs projecting from an opposite z-axis edge of said web in a like x-axis direction, each of said second series of tabs staggered relative to said first series of tabs, in which one or more of tabs of said two series of tabs include a z-axis line of said tabs opposite to a line of dependency thereof from said web, said L-shaped element including an elongate integral yz plane sub-element elongate in a z-axis direction;

(b) inner and outer xz plane concrete slabs cast in situ about said first and second series of tabs respectively, said slabs integrally molded about x- and y-axis peripheries of said panel to thereby form a horizontal beam, a capstan and load bearing, z-axis vertical columns; and (c) a layer of insulating material provided between opposing interior surfaces of said respective outer and inner slabs and within a space therein between said first and second series of tabs of each metallic stud.

2. The panel as recited in claim 1, in which said insulating material comprises a thermal insulator.

3. The panel as recited in claim 1, in which said insulating material comprises an audio insulator.

4. The panel as recited in claim 1, in which said studs comprise 10–25 gauge steel.

5. The panel as recited in claim 4, in which said slabs comprise lightweight concrete.

6. The panel as recited in claim 1, in which at least one end of each stud defines a key-like fit complementally between opposing inner surfaces of said concrete slab.

* * * * *